US005683521A

United States Patent [19]

Matsumoto et al.

[11] Patent Number: 5,683,521

[45] Date of Patent: Nov. 4, 1997

[54] METHOD FOR MANUFACTURING SPRING HAVING HIGH NITRIDED PROPERTIES

[75] Inventors: Sadamu Matsumoto; Teruyuki Murai, both of Itami, Japan

[73] Assignee: Sumitomo Electric Industries, Ltd., Osaka, Japan

[21] Appl. No.: 612,175

[22] Filed: Mar. 7, 1996

[51] Int. Cl.$^6$ ..... C23C 8/26; C21D 9/02; C21D 1/06

[52] U.S. Cl. ..... 148/226; 148/230; 148/580; 148/908

[58] Field of Search ..... 148/580, 908, 148/230, 226

[56] References Cited

FOREIGN PATENT DOCUMENTS

| | | | |
|---|---|---|---|
| 52-10833 | 1/1977 | Japan | 148/230 |
| 406228734 | 8/1994 | Japan | 148/580 |

*Primary Examiner*—Deborah Yee

*Attorney, Agent, or Firm*—Wenderoth, Lind & Ponack

[57] ABSTRACT

A method for forming a spring which can reduce variations in the surface hardness and the thickness of the hardened layer when the spring is nitrided. Before nitriding the spring, the thickness of an oxide film formed on the surface of the spring is reduced to 1.5 μm or less by electropolishing or any other suitable means so that the residual stress of the spring will be −5 kgf/mm$^2$ to 5 kgf/mm$^2$ near its surface. With this arrangement, it is possible to increase the surface hardness and the thickness of the nitrided layer of the spring obtained by nitriding.

2 Claims, No Drawings

METHOD FOR MANUFACTURING SPRING HAVING HIGH NITRIDED PROPERTIES

BACKGROUND OF THE INVENTION

The present invention relates to a spring for which high fatigue resistance is required, such as a valve spring for an engine, and a method of manufacturing such a spring.

A 2–5 μm thick oxide film is provided on a steel wire for spring formed by quenching and tempering to improve lubricity when it is brought into contact with a coiling tool to form springs.

A spring formed from such a steel wire for spring is then annealed at low temperature, descaled and nitrided. Low-temperature annealing is necessary to remove any residual stress produced when forming the spring. Descaling is necessary to remove the oxide film and to improve the effect of the subsequent nitriding treatment. Typically, such descaling is carried out by shot blasting.

But springs descaled by shot blasting have a problem in that variations are rather wide in the hardeness after nitriding and in the depth of the hardened layer formed by nitriding.

As a result of various trials made to solve this problem, we have found out the following facts.

(1) Any residual stress that may remain near the spring surface hinders hardening of the spring.

(2) Shot blasting for descaling is the cause of such residual stress near the spring surface. Variations in the hardness and the depth of the hardened layer after nitriding result from maldistribusion of residual stress in the spring.

Thus, for efficient nitriding with narrow variations, it is important to remove the oxide film while keeping residual stress as small as possible.

SUMMARY OF THE INVENTION

According to the present invention, there is provided a spring having high nitrided properties, the thickness of an oxide film on the surface of the spring being not more than 1.5 μm before the spring is nitrided, and the spring having a residual stress at surface of not less than −5 kgf/mm$^2$ and not more than 5 kgf/mm$^2$ before the spring is nitrided.

Such a spring is obtained by one of the following three methods.

(1) method comprising the steps of forming a steel wire for spring into the shape of a spring, annealing the spring-shaped wire at low temperature, reducing the thickness of an oxide film formed on the surface of the wire to 1.5 μm or less with a chemical and/or an electrical means, and nitriding the spring-shaped wire;

(2) method comprising the steps of forming a steel wire for spring into the shape of a spring, annealing the spring-shaped wire at low temperature, reducing the thickness of an oxide film formed on the surface of the wire to 1.5 μm or less with a mechanical means, annealing the wire at low temperature in an inert gas atmosphere or under vacuum, and nitriding the wire; and (3) method comprising the steps of reducing the thickness of an oxide film formed on the surface of a steel wire to 1.5 μm or less, forming the wire into the shape of a spring, annealing the spring-shaped wire at low temperature in an inert gas atmosphere or under vacuum, and nitriding the wire Now we will explain why the various conditions have been determined in the above manner.

(Thickness of oxide film: 1.5 μm or less)

An oxide layer thicker than 1.5 μm would hinder the diffusion of nitrogen during nitriding. Ideally, the oxide layer is removed completely.

(Residual stress: not less than −5 kgf/mm$^2$ but not more than 5 kgf/mm$^2$)

Outside this range, the diffusion of nitrogen would be too slow to achieve efficient nitriding.

(Means for removing the oxide film)

The oxide film has to be removed because it hinders the diffusion of nitrogen during nitriding treatment. But if it is removed by shot blasting, residual stress will be produced, thus lowering the efficiency of nitriding treatment. Thus, it is necessary to remove the oxide film using a technique that will not produce residual stress. Such techniques include chemical techniques such as pickling and electrical techniques such as electropolishing. One of these techniques may be used alone, or some of them may be used in combination.

If the oxide film is removed using a technique that produces residual stress such as shot blasting or any other mechanical technique, the spring has to be annealed at low temperature to remove the residual stress produced. Such annealing has to be carried out under vacuum or in an atmosphere filled with an inert gas such as argon to prevent the re-formation of an oxide film.

Instead of removing the oxide film after forming the steel wire for spring into the spring in the above manner, the oxide layer on the spring steel wire may be removed before forming it into the spring. In this case, the oxide film may be removed with any desired technique including a technique that produces residual stress. After forming the spring, residual stress is removed by subjecting it to low-temperature annealing in an inert gas atmosphere or under vacuum so that no oxide film will form.

DETAILED DESCRIPTION OF THE PREFERRED EMBODIMENT

Examples of the invention are now described.

(EXAMPLE 1)

Springs were formed from an oil-tempered steel wire having a diameter of 4 mm. They were subjected to low-temperature annealing after removing the oxide films on their surfaces to provide springs that differed from one another in the thickness of the oxide film and the residual stress. They were then subjected to nitriding treatment for four hours at 450° C. In order to evaluate the efficiency of nitriding, the hardness of each spring at the depth of 20 μm from the surface was measured as the surface hardness. Also, as the thickness of the nitrided layer, we measured the depth from the surface at which the hardness decreased to a value equal to the core hardness. The results are shown in Table 1. Higher surface hardness and/or thicker nitrided layer means higher efficiency of nitriding treatment. The core hardness HV of any nitrided spring was about 470.

As seen in the Table 1, a spring having a thinner oxide film and a lower residual stress has a higher surface hardness and a thicker nitrided layer.

(EXAMPLE 2)

Springs were formed from three different kinds of steel wires with oxide films having different thicknesses as shown below. They were subjected to the treatments shown in Table 2. Before nitriding them, we measured the thickness of the oxide layer and the residual stress for each spring. After nitriding, the surface hardness and the depth of the nitrided layer were measured. The results are shown in Tables 2 and 3. The low-temperature annealing was conducted at 450° C. for 20 minutes.

steel wire I for spring: thickness of the oxide layer=0 μm steel wire II for spring: thickness of the oxide layer=1.1 μm steel wire III for spring: thickness of the oxide layer=4.2 μm As seen in Tables 2 and 3, any of the Examples of the invention was superior in the surface hardness and the thickness of the nitrided layer to any Comparative Examples. Such superior results show high efficiency of nitriding treatment.

According to the present invention, residual stress in the spring is reduced to a minimum before nitriding. Thus, it can be nitrided with high efficiency. Also, it is possible to minimize variations in the surface hardness and the thickness of the nitrided layer.

[TABLE 1]

| | Thickness of oxide film (μm) | Residual stress (kgf/mm$^2$) | Surface hardness (Hv) | Thickness of nitrided layer (μm) |
|---|---|---|---|---|
| Example | | | | |
| A | 0 | 2 | 603 | 160 |
| B | 1.1 | −3 | 597 | 140 |
| Comparative Example | | | | |
| C | 0 | −24 | 589 | 90 |
| D | 0 | −74 | 596 | 80 |
| E | 2.0 | 2 | 555 | 90 |
| F | 4.1 | 2 | 486 | 50 |

[TABLE 2]

| | Type of steel wire | Atmosphere for annealing | Descaling method | Atmosphere for annealing | Surface hardness (Hv) | Thickness of nitrided layer (μm) |
|---|---|---|---|---|---|---|
| Example | | | | | | |
| G | III | In atmosphere | Electro-polishing | — | 594 | 160 |
| H | III | In atmosphere | Shot blasting | In Ar gar. | 600 | 140 |
| I | I | In Ar gas | — | — | 609 | 160 |
| J | II | In Ar gas | — | — | 603 | 150 |
| Comparative Example | | | | | | |
| K | III | In atmosphere | Shot blasting | — | 594 | 80 |
| L | III | In atmosphere | Shot blasting | In atmosphere | 548 | 90 |
| M | I | In atmosphere | — | — | 559 | 60 |

Type of steel wire
I: Thickness of oxide layer = 0
II: Thickness of oxide layer = 1.1 μm
III: Thickness of oxide layer = 4.2 μm

[TABLE 3]

| | Thickness of oxide film (μm) | Residual stress (kgf/mm$^2$) |
|---|---|---|
| Example | | |
| G | 0 | −4 |
| H | 0.2 | 3 |
| I | 0.3 | 1 |
| J | 1.2 | −2 |
| Comparative Example | | |
| K | 0 | −81 |
| L | 2.4 | −3 |
| M | 2.1 | 4 |

What is claimed is:

1. A method of manufacturing a spring having high nitrided properties, said method comprising the steps of forming a steel wire for spring into the shape of a spring, annealing said spring-shaped wire at low temperature, reducing the thickness of an oxide film formed on the surface of said wire to a thickness of 1.5 μm or less with chemical and/or electrical means, and nitriding said spring-shaped wire.

2. A method of manufacturing a spring having high nitrided properties according to claim 1 wherein said spring has a residual stress at a surface thereof of not less than −5 kgf/mm$^2$ and not more than 5 kgf/mm$^2$ before the spring is nitrided.

* * * * *